US008276384B2

(12) United States Patent
Negre et al.

(10) Patent No.: US 8,276,384 B2
(45) Date of Patent: Oct. 2, 2012

(54) AMBIENT TEMPERATURE THERMAL ENERGY AND CONSTANT PRESSURE CRYOGENIC ENGINE

(75) Inventors: Guy Negre, Villeneuve Loubet (FR); Cyril Negre, Carros Cedex (FR)

(73) Assignee: MDI-Motor Development International S.A., Luxembourg (LU)

( * ) Notice: Subject to any disclaimer, the term of this patent is extended or adjusted under 35 U.S.C. 154(b) by 585 days.

(21) Appl. No.: 12/374,034

(22) PCT Filed: Jul. 17, 2007

(86) PCT No.: PCT/EP2007/057380
§ 371 (c)(1),
(2), (4) Date: Feb. 11, 2009

(87) PCT Pub. No.: WO2008/009681
PCT Pub. Date: Jan. 24, 2008

(65) Prior Publication Data

US 2010/0005801 A1 Jan. 14, 2010

(30) Foreign Application Priority Data

Jul. 21, 2006 (FR) ..... 06 06647

(51) Int. Cl.
*F01K 25/08* (2006.01)
*F01K 25/00* (2006.01)
*F01K 23/06* (2006.01)

(52) U.S. Cl. ..... 60/671; 60/651; 60/670

(58) Field of Classification Search ..... 60/645–681
See application file for complete search history.

(56) References Cited

U.S. PATENT DOCUMENTS 3,232,050 A * 2/1966 Robinson et al. ..... 60/671
3,842,333 A * 10/1974 Boese et al. ..... 322/35
4,359,118 A 11/1982 Latter
4,674,288 A 6/1987 Kuriyama
(Continued)

FOREIGN PATENT DOCUMENTS

BE 635509 1/1964
(Continued)

OTHER PUBLICATIONS

International Search Report dated Nov. 26, 2007, in PCT application.

*Primary Examiner* — Thomas Denion
*Assistant Examiner* — Christopher Jetton
(74) *Attorney, Agent, or Firm* — Young & Thompson

(57) ABSTRACT

Ambient temperature thermal energy cryogenic engine with constant pressure with continuous "cold" combustion at constant pressure and with an active chamber operating with a cryogenic fluid stored in its liquid phase, and used as a work gas in its gaseous phase and operating in a closed cycle with return to its liquid phase. The initially liquid cryogenic fluid is vaporized in the gaseous phase at very low temperatures and supplies the inlet of a gas compression device, which then discharges this compressed work gas, still at low temperature, and through a heat exchanger with the ambient temperature, into a work tank or external expansion chamber fitted or not fitted with a heating device, where its temperature and its volume will considerably increase in order to then be preferably let into a relief device providing work and for example comprising an active chamber according to international patent application WO 2005/049968.

15 Claims, 5 Drawing Sheets

U.S. PATENT DOCUMENTS

| | | | | |
|---|---|---|---|---|
| 4,765,143 | A * | 8/1988 | Crawford et al. | 60/671 |
| 6,311,486 | B1 | 11/2001 | Negre | |
| 7,047,744 | B1 * | 5/2006 | Robertson et al. | 60/670 |

FOREIGN PATENT DOCUMENTS

| | | |
|---|---|---|
| EP | 1271075 | 1/2003 |
| FR | 1518241 | 3/1968 |
| FR | 2814530 | 3/2002 |
| FR | 2862349 | 5/2005 |
| FR | 2887591 | 12/2006 |
| JP | 2006138288 | 6/2006 |
| WO | 9627737 | 9/1996 |
| WO | 9739232 | 10/1997 |
| WO | 9812062 | 3/1998 |
| WO | 9815440 | 4/1998 |
| WO | 9832963 | 7/1998 |
| WO | 9920881 | 4/1999 |
| WO | 9937885 | 7/1999 |
| WO | 9963206 | 12/1999 |
| WO | 0169080 | 9/2001 |
| WO | 9748884 | 5/2002 |
| WO | 03089764 | 10/2003 |
| WO | 2005037069 | 4/2005 |
| WO | 2005043052 | 5/2005 |
| WO | 2005049968 | 6/2005 |
| WO | WO 2005049968 A1 * | 6/2005 |

* cited by examiner

AMBIENT TEMPERATURE THERMAL ENERGY AND CONSTANT PRESSURE CRYOGENIC ENGINE

The invention relates to an engine.

BACKGROUND OF THE ART

More particularly, the invention relates to an engine operating in particular with a cryogenic fluid and, for example, using a device for controlling the stroke of the piston having the effect of stopping the piston at its top dead centre for a period of time and of rotating the engine, and a variable volume active chamber producing work, an integrated (or separate) compression device and a device for recovering ambient temperature thermal energy.

The inventors have filed many patents and patent applications relating to drives and their installations, using gases and more particularly compressed air for a totally clean operation in an urban and suburban site:

WO 96/27737-WO 97/00655-WO 97/39232-WO 97/48884-WO 98/12062-WO 98/15440-WO 98/32963-WO 99/37885-WO 01/69080-WO 03/036088.

To apply these inventions, they have also described in patent application WO 99/63206, to the content of which it is possible to refer, a method and a device for controlling the stroke of the engine pistons making it possible to stop the piston at its top dead centre; a method also described in their patent application WO 99/20881, to the content of which it is also possible to refer, relating to the operation of these engines with single energy or with dual-energy, dual or triple supply modes.

In patent application WO 99/37885, they propose a solution that makes it possible to increase the quantity of energy that can be used and is available, characterized in that the compressed air, before it is inserted into the combustion or expansion chamber, originating from the storage reservoir either directly or after it has passed into the heat exchangers of the ambient temperature thermal energy recovery device, and before it is inserted into the combustion chamber, is channelled into a thermal reheater where, by the increase of its temperature, it will again increase in pressure and/or in volume before it is inserted into the combustion chamber and/or expansion chamber of the engine, thereby again considerably increasing the performance that can be achieved by the said engine.

The use of a thermal reheater, and despite the use of a fossil fuel, has the advantage of being able to use clean continuous combustions that can be catalysed or depolluted by all known means for the purpose of obtaining emissions with infinitesimal pollutants.

The inventors have filed a patent application WO 03/036088, to the content of which it is possible to refer, relating to an additional compressed air injection motor-compressor—motor-alternator set operating on single and multiple energies.

In these types of engine operating with a gas, more particularly with compressed air and comprising a high pressure compressed air reservoir, it is necessary to relieve the compressed air contained in the high pressure reservoir but whose pressure reduces as the reservoir empties to a stable intermediate pressure called the final pressure of use in a buffer tank before it is used in the engine cylinder or cylinders. The well known conventional pressure reducers with valves and springs have very low throughputs and their use for this application requires very heavy and not very efficient apparatus, they are also very sensitive to freezing up due to the humidity of the cooled air during the relief.

To solve this problem, the inventors have also filed a patent application WO 03/089764 relating to a variable rate dynamic pressure reducer for compressed air injection engines, comprising a high pressure compressed air reservoir, and a work tank.

In these pressure reducing devices, the filling of the chamber always represents pressure relief that is harmful to the general output of the machine.

To solve the latter problem, the inventors have also filed a patent application WO 2005/049968 relating to an active chamber engine that uses a device for stopping the piston at top dead centre. It is preferably supplied by compressed air—or any other compressed gas—contained in a high pressure storage reservoir, through a buffer tank called the work tank. The work tank in a dual-energy version comprises a device for reheating the air supplied by an additional energy (fossil or other energy) making it possible to increase the temperature and the volume of the air passing through it. The work tank is therefore an external combustion chamber.

In this type of engine, the expansion chamber inside the engine consists of a variable volume fitted with means making it possible to produce work and is coupled and in contact via a permanent passage with the space lying above the main drive piston. During the stopping of the drive piston at its top dead centre, the pressurized air or gas is let into the active expansion chamber when the latter is at its smallest volume and, under the thrust, will increase its volume while producing work; when the active chamber is substantially at its largest volume, the inlet is then closed and the compressed air still under pressure contained in the active expansion chamber expands in the engine cylinder thereby pushing the drive piston in its downstroke and supplying work in its turn; during the upstroke of the drive piston during the exhaust stroke, the variable volume of the expansion chamber is returned to its smallest volume in order to recommence a complete work cycle.

The thermodynamic cycle of an active chamber engine therefore comprises four phases in compressed air single energy mode:

An isothermal expansion without work

A transfer—slight expansion with work called quasi-isothermal

A polytropic relief with work

An exhaust at quasi-ambient pressure.

In its dual-energy application and in the additional fuel mode, an air compressor supplies either the high pressure reservoir or the work tank (combustion chamber) or else both volumes in combination.

The active chamber engine can also be produced in single-energy mode with fossil fuel. In a version as described above, the high pressure compressed air storage reservoir is then purely and simply removed and the air compressor directly supplies the work tank that comprises the air reheating device supplied by a fossil or other energy.

The active chamber engine is an engine with an external combustion chamber, however, the combustion in the reheater may be either internal, called "external internal" by bringing the flame directly into contact with the work compressed air, or external, called "external external" by reheating the work air through a heat exchanger.

This type of engine operates in combustion with constant pressure and variable volume according to the relations: PV1=nRT1 and PV2=nRT2

Where for constant $P$, $V1/V2=T1/T2$

The temperature increase at constant pressure has the effect of increasing in the same proportion the volume of compressed air, and an increase in volume of N times will require an identical temperature increase of N times.

In the dual-energy mode and operating autonomously with additional energy, and when the compressed air is let into the high pressure reservoir, the thermodynamic cycle then comprises seven phases:

Aspiration
Compression
Isothermal expansion in the work tank
Temperature increase
Transfer—slight expansion with work called quasi-isothermal
Polytropic relief with work
Exhaust at quasi-atmospheric pressure When the compressed air is let directly into the work tank or combustion chamber, the thermodynamic cycle comprises six phases and becomes:

Aspiration
Compression
Temperature increase
Transfer—slight expansion with work called quasi-isothermal
Polytropic relief with work
Exhaust at quasi-atmospheric pressure In this type of engine with dual-energy application, the temperature of the compressed air let into the work tank or combustion chamber takes place at a temperature equal to or greater than the ambient temperature, substantially equal if the compressed air originates from the high pressure storage reservoir and greater if it comes directly from the compressor and the increased volume is achieved in the following phase of the cycle by increase of the pressure.

Originating directly from the compressor, the air temperature may reach, for example, values of the order of 400° C. (673 Kelvin degrees) above the ambient temperature.

To fix ideas, as a nonlimiting example, for the purpose of supplying an active chamber of 30 $cm^3$ at 30 bar, a compressed air load of 5 $cm^3$ at 30 bar and at ambient temperature of 293 K (20° C.) is taken from the storage reservoir in order to be inserted into a work and constant pressure reheating chamber in which, to obtain the required 30 $cm^3$, it is necessary to achieve a combustion that will take the temperature to six times the initial value namely 1758 K or 1485° C.

If the 5 $cm^3$ load originates directly from the compressor, it is substantially at a temperature of 693° K (420° C.) and, for the same result, the temperature of the load must be taken to six times 693 K namely 2158° K or 1885° C.

The use of high temperatures in the external combustion chamber causes numerous stresses in terms of materials and coolings and pollutant emission particularly of NOx (nitrogen oxides) that form above 1000° C.

To solve the latter problem, the inventors have also filed a French patent application No 0506437 (FR-A-2.887.591) relating to a low temperature motor-compressor set with continuous "cold" combustion at constant pressure and with an active chamber that proposes to solve these stresses by allowing, for equivalent performance, much colder combustions which, paradoxically, provide a considerable increase in output of the machine.

The low temperature motor-compressor set with continuous "cold" combustion at constant pressure and with an active chamber comprises a cold chamber making it possible to lower to low or very low temperatures the atmospheric air that supplies the inlet of a compressed air device, that then discharges this compressed work air, still at low temperature, into an external work tank or combustion chamber fitted with an air reheating device, where it considerably increases in volume in order then to be preferably let into an active chamber according to patent application WO 2005/049968 where, during a stop of the drive piston at its top dead centre, the pressurized air or gas is let into the active expansion chamber when the latter is at its smallest volume and, under the thrust, will increase its volume while producing work; when the active chamber is substantially at its largest volume, the inlet is then closed and the still pressurized compressed air contained in the active expansion chamber expands in the engine cylinder thereby pushing the drive piston in its downstroke and providing work in its turn; during the upstroke of the drive piston during the exhaust stroke, the variable volume of the expansion chamber is returned to its smallest volume in order to recommence a complete work cycle.

The thermodynamic cycle of the low temperature motor-compressor set with continuous "cold" combustion at constant pressure and with an active chamber according to French patent application FR 0506437 comprises seven phases:

Considerable reduction of the atmospheric air temperature
Aspiration
Compression
Temperature increase (combustion at constant volume)
Quasi-isothermal transfer
Polytropic relief
Exhaust to the atmosphere at quasi-atmospheric pressure.

SUMMARY OF THE INVENTION

In the low temperature motor-compressor set using the thermodynamic cycle according to the invention, the inlet air of the compressor is very greatly cooled in the cold chamber of a refrigeration (or cryogenic) machine using liquids that absorb the heat in order to vaporize, where a refrigerant or cryogenic fluid initially in the gaseous state is compressed thanks to a cryogenic compressor and discharged into a coil where it liquefies, this liquefaction phenomenon gives off heat, and the liquid is then inserted into an evaporator positioned in the cold chamber where it vaporizes (a phenomenon that absorbs heat). The vapour thus generated returns to the compressor and the cycle can recommence. The work air contained in the cold chamber is then considerably cooled and contracted, it is then aspirated, and compressed by an air compressor again at low temperature, into the combustion chamber, where it is reheated and considerably increases in volume before it is transferred quasi-isothermally into the active chamber producing work before its polytropic relief in the engine cylinder producing work in its turn.

In order to fix ideas, if a compressed air load of 5 $cm^3$ is inserted by the air compressor directly into a work and combustion chamber at a pressure of 30 bar and at a temperature of 90 K, in order to make it possible to supply at 30 bar an active chamber of 30 $cm^3$, it is necessary to produce a combustion that will take the temperature to six times its initial value namely 540 K or 267° C.

According to a variant of the invention, the compressed work air at the outlet of the compressor, still at low temperature, passes through an air/air exchanger before being directed towards the combustion chamber and thereby returns virtually to the ambient temperature while considerably increasing in volume before it is inserted into the combustion chamber. The necessary needs of thermal energy provision are therefore considerably reduced.

To fix ideas, as a comparative example, if a 5 $cm^3$ load of compressed air originating from the air compressor at 90 K passes through an air/air exchanger and sees its temperature brought to virtually ambient temperature or 270 K, the volume inserted into the work and reheating chamber is then 15 $cm^3$, and, still to supply the active chamber at 30 bar, it is then necessary to achieve a combustion that will take the temperature to only twice its value (or 540° K) thereby making a considerable saving of energy provided by the fuel.

The descriptions of these foregoing inventions and of the present text indicate air temperature values under generic denominations—"very low temperatures", "low temperatures", "ambient" or "ambient temperature" and "cold combustion". The operating temperatures are in fact relative to one another, however, in order to clarify ideas and, in a non-limiting manner, the author uses the term "very low temperatures" for values less than 90 K, the term "low temperatures" for values less than 200 K, the term "ambient" for values between 273 and 293 K—as for the term ""cold" combustion"—it is a comparison with the combustion temperatures of current engines greater than 2000 K—for values situated between 400 and 1000 K.

In this type of low temperature motor-compressor set with continuous "cold" combustion at constant pressure and with an active chamber according to French patent application FR 0506437, the cryogenic machine for cooling the "cold chamber" is designed to reduce the temperature of the air or of the work gas to the lowest possible temperature from the ambient temperature at approximately 290 K. The efficiency of this set however remains limited by the temperature of the work gas used which cannot be less than the temperature for liquefying the said work gas.

Like the active chamber engine and the cold combustion motor-compressor set according to French patent application No FR 0506437 described above, the ambient temperature thermal energy and constant pressure cryogenic engine according to the present invention uses a compressed work gas and preferably, but not only, an active chamber relief volumetric device.

According to the present invention, it is proposed:

An engine using an active chamber volumetric relief device consisting of a variable volume fitted with means making it possible to generate work when it is filled, coupled, and in permanent contact via a passage, with the space lying above a main drive piston, and an integrated or a non integrated compression device, characterized:

- in that the work gas is a cryogenic fluid used in closed cycle stored in the liquid phase working in the gaseous phase and returned to a storage reservoir in the liquid phase,
- in that the work gas, initially liquid, is vaporized in the gaseous phase at very low temperatures, substantially at its vaporization temperature, and supplies the inlet of a gas compression volumetric device, in which it is compressed to its work pressure,
- in that this compressed work gas, still at very low temperatures at the outlet of the compressor, is discharged into an expansion tank at its work pressure and taken, by heat exchange with the atmosphere, substantially to the ambient temperature, such that, under the effect of the transfer of thermal energy from the ambient temperature, its temperature increasing considerably, its volume increases in the same proportions according to the constant pressure relation:

$$V1/V2=T1/T2,$$

- in that the said gas still compressed at its work pressure and still substantially at the ambient temperature is then let into a volumetric relief device with work that comprises an active expansion and relief chamber,
- in that the work gas, on being exhausted from the said volumetric relief device with work again at very low temperature after its relief, is discharged towards the storage tank of cryogenic fluid where it is liquefied in order to recommence a new cycle, such as to constitute an ambient temperature thermal energy and constant pressure cryogenic engine.

According to other features of engine:

- its thermodynamic cycle comprises the following seven phases:
  - Vaporization of a cryogenic fluid
  - Compression of this fluid at very low temperatures
  - Reheating at constant pressure by the ambient temperature
  - Quasi-isothermal transfer producing work
  - Polytropic relief providing work with temperature reduction
  - Closed cycle exhaust into the storage reservoir
  - Liquefaction of the gas returned to the storage reservoir.
- the vaporization of the fluid in the liquid phase in the storage reservoir is obtained by heating by using a work fluid/work fluid exchanger in which the cryogenic fluid then in the semi-gaseous phase and returned from the exhaust of the volumetric relief device and that is at a sufficient temperature to do so, heats and vaporizes a portion of the cryogenic fluid in the liquid phase that is in the storage reservoir while cooling and liquefying.
- the cryogenic fluid liquefaction vaporization heat exchanger consists of a coil immersed in the tank in which the fluid originating from the exhaust of the engine will terminate its cooling and its liquefaction while giving off the heat necessary to vaporize the fluid in the liquid state in the storage reservoir.
- a cryogenic machine is positioned between the exhaust outlet of the volumetric relief device and the fluid storage reservoir in order to make it possible to adjust the temperature of the work gas relieved at the outlet of the exhaust then in the gaseous or semi-gaseous phase and before it is inserted into the heat exchanger of the storage reservoir in order to be liquefied therein; the fluid in the gaseous or semi-gaseous state at the outlet of the exhaust of the relief device is then cooled during its passage in a heat exchanger positioned in the cold chamber of the cryogenic machine.
- the cryogenic machine operates by using the magnetic-calorific effects that use the property that certain materials have to heat up under the effect of a magnetic field and to cool down to a temperature lower than their initial temperature after the magnetic field has disappeared or after a variation of this magnetic field.
- its thermodynamic cycle comprises eight phases:
  - Vaporization of a cryogenic fluid
  - Compression of this fluid at very low temperatures
  - Reheating of this fluid by the ambient temperature at constant pressure
  - Quasi-isothermal transfer providing work
  - Polytropic relief providing work with temperature reduction
  - Closed cycle exhaust into the storage reservoir
  - Cooling in a cryogenic machine
  - Liquefaction of the gas returned to the storage reservoir.
- the constant pressure expansion tank consists of a large volume working pressure storage reservoir in which the work gas contained therein, kept at the ambient temperature, according to: the heat exchange surface area of its casing with the atmosphere, its volume and the storage time in the said reservoir, and in that the compressed work gas originating from the compressor is taken virtually to the ambient temperature naturally by mixing with the work gas at ambient temperature already contained in the said pressure storage reservoir. Depending on the volume of the storage reservoir and the storage time in the said reservoir, and the surface area of its wall in contact with the atmosphere, the return to ambient temperature may be obtained naturally by mixing with the gas at ambient temperature already contained in the reservoir and held at the ambient temperature by heat exchange with the ambient temperature, through the wall.

the casing of the said pressure storage reservoir comprises external and/or internal heat exchange means such as fins for promoting the heat exchange between the atmosphere and the work gas contained therein, thus making it possible to considerably increase the heat exchange surface areas and improve its efficiency of heat exchange with the atmosphere.

at least one atmospheric air/work gas exchanger is installed between the compressor and the constant pressure expansion tank and/or the work pressure expansion reservoir, and/or between the said reservoir and the relief device with work, in order to activate the return of the said work gas to the ambient temperature.

a work gas heating device is positioned before its insertion into the engine making it possible to obtain temperatures higher than the ambient temperature, the temperature increase then being achieved in a combustion chamber of the external-external type through a heat exchanger so as not to soil by combustion the cryogenic fluid in its gaseous phase.

its thermodynamic cycle comprises the following nine phases:

Vaporization of a cryogenic fluid

Compression of this fluid at very low temperatures

Reheating of this fluid by the ambient temperature at constant pressure

Reheating and temperature increase greater than the ambient temperature

Quasi-isothermal transfer providing work

Polytropic relief providing work with temperature reduction

Closed cycle exhaust into the storage reservoir

Cooling in a cryogenic machine

Liquefaction of the gas returned to the tank.

it comprises a device for controlling the stroke of the piston causing the piston to stop at its top dead centre for a period of time, and an active chamber, during the stopping of the drive piston at its top dead centre, the pressurized gas is let into an active expansion and relief chamber,—which consists of a variable volume fitted with means making it possible to generate work, and that is coupled and in permanent contact via a passage, with the space lying above the main drive piston—when the latter is at its smallest volume and which, under the thrust of the work gas, will increase its volume while producing work;

in that, when the active expansion and relief chamber is substantially at its largest volume, the inlet is then closed and the work gas still compressed under pressure, contained in the said chamber, expands in the engine cylinder thereby pushing back the drive piston in its downstroke while producing work in its turn and thereby undergoing a major reduction of temperature, during the upstroke of the drive piston during the exhaust stroke, the variable volume of the active expansion and relief chamber is returned to its smallest volume in order to recommence a complete work cycle.

To fix ideas, as a non-limiting example, with the use of helium (He) as the cryogenic fluid whose vaporization temperature is five degrees Kelvin (5 K), and to make it possible to supply with work gas an active chamber of 30 $cm^3$ at 30 bar, the aspirated volume of the gas compressor is 15 $cm^3$ at 5 K, and the discharged volume is 1.91 $cm^3$ of work gas at 19 K and 30 bar. This same work gas, taken by heat exchange to the ambient temperature of 293 K (isochoric heating), finding its energy in the atmosphere increases by (293/19) 15.42 times in volume, at the same pressure (30 bar) to reach the required 30 $cm^3$ (1.91*15.42=30 $cm^3$). The gas relieved in the volumetric relief device and after having supplied work is at a temperature of the order of 90 K at atmospheric pressure. It is then cooled then liquefied and returned to the storage tank to allow a new cycle.

In the above example, the compression by engine revolution of a small volume of gas (15 $cm^3$ aspirated) represents negative work of little importance, substantially of the order of 0.88 KW (1.2 hp) at 4000 rpm, making it possible to obtain 1.9 $cm^3$ at 30 bar, and, at only 19 K, the ambient thermal energy then makes it possible, by heat exchange with the atmosphere, to take the volume of this gas to 30 $cm^3$ which, expanded in the active chamber volumetric relief device, produces work of almost 12 KW (16 hp), while the energy necessary to return the temperature of the exhaust gas from 90 K to its liquefaction temperature (5 K) represents 3.29 KW (4.4 hp). Almost 10 hp (7.65 KW) are therefore provided by the ambient temperature thermal energy during the temperature increase.

The very low temperature work gas compressor advantageously consists of a cryogenic compressor allowing its operation at the temperatures used; it is either driven by the engine shaft of the active chamber volumetric relief device or incorporated into the design of the volumetric relief device (for example with two-stage pistons). The number of stages of the compressor and its operating method: alternating pistons, rotary piston, rotary with paddles, compressor with membrane, turbine, may vary without for all that changing the principle of the invention.

Arrangements in combination comprising one or more constant pressure expansion tanks, of greater or lesser volume, and one or more heat exchangers positioned before and/or after the said expansion tank may be produced by those skilled in the art without, for all that, changing the principle of the invention described. The same applies to the design of the heat exchanger or exchangers that may use gases (ambient air/gas), liquids (liquids/work gas) or solids (solids/work gas) making it possible to provide the work gas with the calories of the ambient temperature of the atmosphere.

The vaporization of the fluid in the liquid phase in the tank may be achieved by all known means of heating or reheating but preferably, and according to the invention, it is achieved by using the temperature of the cryogenic fluid returned from the engine exhaust, that is at a sufficient temperature to do this, by heat exchange in a heat exchanger consisting for example of the coil immersed in the storage tank and in which the fluid originating from the engine exhaust terminates, by reciprocal exchange, its cooling and its liquefaction by giving off the heat necessary for vaporization.

Advantageously, the output of the coil is placed in the bottom of the tank containing the cryogenic fluid in liquid form with the arrival of the said coil in the portion immersed in the top portion of the liquid that is the first to have to be vaporized.

Advantageously, the cryogenic machine, designed to produce cold, is positioned between the engine exhaust outlet and the fluid tank in order to make it possible to adjust the temperature of the exhaust fluid in the gaseous or semi-gaseous phase before it is inserted into the heat exchanger of the tank. The expanded work gas, and also in the gaseous state, emerging from the engine exhaust is then cooled in the cold chamber of a cryogenic machine using liquids that absorb the heat in order to vaporize, and in which the cryogenic fluid initially in the gaseous state is compressed thanks to a cryogenic compressor, then discharged into a coil where it is liquefied, this liquefaction phenomenon gives off heat; the liquid is then inserted into an evaporator positioned in the cold chamber, where it vaporizes (a phenomenon that absorbs heat and hence produces cold) and the vapour thus produced returns to the compressor and the cycle can recommence.

Advantageously, the invention may use a magnetic-calorific effect cryogenic machine.

A first technology, based on the use of large-sized superconductor magnetic assemblies, is used in laboratories and in the field of nuclear research to reach temperatures close to absolute zero. In particular, patent U.S. Pat. No. 4,674,288 is known that describes a helium liquefaction device comprising a magnetizable substance that can move in a magnetic field generated by a superconducting coil and a reservoir containing helium and in thermal conduction with the said superconducting coil. The movement in translation of the magnetisable substance generates cold that is transmitted to the helium by means of conducting elements. Also known is patent WO 2005/043052 to which reference can be made that describes a heat flux generation device made of magnetic-calorific material comprising a unit of heat flux generation provided with at least two heat members each containing at least one magnetic-calorific element, magnetic means arranged to emit at least one magnetic field, movement means coupled with the magnetic means in order to move them relative to the magnetic-calorific elements in order to subject them to a variation or a removal of the magnetic field so as to cause their temperature to vary, and means for recovering the calories and/or refrigeration emitted by these magnetic-calorific elements.

The device for reheating the work gas positioned before its insertion into the engine makes it possible to obtain temperatures greater than the ambient temperature. This reheating of the work gas may be obtained by combustion of a fossil fuel in additional fuel mode, the compressed air contained in the work tank is reheated by an additional energy in a thermal reheater. This arrangement makes it possible to increase the quantity of energy that can be used and is available by the fact that the work gas compressed before it is inserted into the active chamber volumetric relief device will increase its temperature and increase in volume making possible the increase in performance of the engine for one and the same cylinder capacity. The use of a thermal reheater has the advantage of being able to use clean continuous combustions that may be catalysed or depolluted by all known means for the purpose of obtaining infinitesimal pollutant emissions.

The temperature increase is then achieved in a combustion chamber of the external-external type through a heat exchanger so as not to soil by combustion the cryogenic fluid in its gaseous phase.

The thermodynamic cycle of the engine according to this variant of the invention is characterized in that it comprises the above listed nine phases.

The cryogenic engine according to the invention may operate with all the known cryogenic fluids, depending on the specifications of the motorist, the performance sought and the costs generated, however, in order to obtain greater power, it will use the fluid having the lowest boiling temperature that allows the largest possible temperature difference between its liquid phase and its vaporization temperature and the temperature of the fluid, close to the ambient temperature, in the gaseous phase when it is inserted into the cylinder of the active chamber, this temperature difference determining the efficiency of the engine.

Amongst the refrigeration and cryogenic fluids that are known are helium (He) whose boiling temperature is 5 K, hydrogen ($H_2$) whose boiling temperature is 20 K or else nitrogen ($N_2$) whose boiling temperature is 77 K that may be used to obtain the results sought.

Gas mixtures modifying these features according to requirements may also be used.

The compression mode of the refrigeration machine, the evaporators and the heat exchangers, the materials used, the refrigeration or cryogenic fluids, the type of liquefaction cryogenic machine used to apply the invention may vary without for all that changing the invention described.

All mechanical, hydraulic, electric or other arrangements allowing the accomplishment of the evaporation, compression, active chamber work cycles, namely insertion of the inlet load by increase of volume producing work followed by maintenance at a determined volume that is the real chamber volume during the expansion stroke of the drive piston, then of the return to its minimum volume in order to allow a new cycle, may be used without, for all that, changing the invention that has just been described.

The internal expansion chamber of the volumetric relief device of the engine according to the invention actively participates in the work. The volumetric relief device according to the invention is called "active chamber".

The variable volume expansion and relief chamber called active chamber may consist of a piston called a pressure piston sliding in a cylinder and connected via a connecting rod to a crankpin of the engine crankshaft. However, other mechanical, electrical or hydraulic arrangements making it possible to perform the same functions and the thermodynamic cycle of the invention may be used without, for all that, changing the principle of the invention.

All the movable equipment of the volumetric relief device (piston and pressure lever) is balanced by extending the lower arm beyond its immobile end, or pivot, by a mirror pressure lever opposite in direction, symmetrical and of identical inertia to which is attached, able to move on an axis parallel to the axis of movement of the piston, an identical inertia weight and opposite in direction to that of the piston. "Inertia" is called the product of the weight times the distance of its centre of gravity to the point of reference. In the case of a multi-cylinder volumetric relief device, the opposite weight may be a piston operating normally like the piston that it balances.

The device according to the present invention may use this latter arrangement in which the axis of the opposite cylinders, and the fixed point of the pressure lever are substantially in line on the same axis and where the axis of the control connecting rod linked to the crankshaft is positioned on the other hand not on the common axis of the articulated arms but on the arm itself between the common axis and the fixed point or pivot. Accordingly, the lower arm and its symmetry represent a single arm with the pivot, or fixed point, substantially at its centre and two spindles at each of its free ends connected to the opposed pistons.

The number of cylinders may vary without, for all that, changing the principle of the invention while preferably sets in even numbers of two opposing cylinders are used or else, in order to obtain greater cyclic regularity, more than two cylinders, for example four or six etc.

According to another variant of the invention, the ambient temperature thermal energy cryogenic engine consists of several expansion stages, each stage comprising an active chamber according to the invention where, between each stage, a heat exchanger is positioned making it possible to reheat the exhaust air of the preceding stage and/or where necessary a reheating device with additional energy. The cylinder sizes of the next stage being greater than those of the previous stage.

The ambient temperature thermal energy and constant pressure cryogenic engine advantageously uses a volumetric relief device with work fitted with an active chamber according to patent application WO 2005/049968.

However, and according to a variant of the invention, it is proposed:

An Engine Characterized:

- in that the work gas is a cryogenic fluid used in a closed cycle stored in the liquid phase working in the gaseous phase and returned to a storage reservoir in the liquid phase,
- in that the initially liquid cryogenic fluid is vaporized in the gaseous phase at very low temperatures and supplies the inlet of a gas compression device, which then discharges this gas, compressed to its working pressure and still at low temperature, through an atmospheric air/work gas exchanger, and/or directly, into a constant pressure expansion tank comprising or not comprising a heating device, in which, its temperature increasing considerably, its volume increases in the same proportions according to the constant pressure relation: $V1/V2=T1/T2$,
- in that the said gas, still compressed at its working pressure, is then let into a volumetric relief device with work used, on conventional engines with the conventional crank connecting rod device, or else on rotary piston eingines or other internal combustion devices producing a relief with work,
- in that the work gas at the exhaust of the volumetric relief device with work, again at very low temperature after its relief, is discharged to the storage reservoir of the cryogenic liquid through a cryogenic machine positioned between the exhaust outlet and the fluid tank (A1) in order to make it possible to adjust the temperature of the work gas relieved at the exhaust outlet then in the gaseous or semi-gaseous phase and before its insertion into the heat exchanger of the storage reservoir in order to be liquefied therein; the fluid in the gaseous or semi-gaseous state at the exhaust outlet of the relief device is then cooled during its passage into a heat exchanger positioned in the cold chamber of the cryogenic machine, and liquefied in order to recommence a new cycle.

The thermodynamic cycle of the engine according to this variant of the invention is characterized in that it comprises seven phases:

- Vaporization of a cryogenic fluid
- Compression of this fluid at very low temperatures
- Reheating of this fluid by the ambient temperature at constant pressure
- Polytropic relief providing work with temperature reduction
- Closed cycle exhaust into the tank
- Cooling in a cryogenic machine
- Liquefaction of the gas returned to the tank.

The ambient temperature thermal energy and constant pressure cryogenic engine can be used on all land, sea, rail, air vehicles as well as in any fixed station application such as a motor pump set, driving various machines (machine tools for example).

The ambient temperature thermal energy and constant pressure cryogenic engine may also and advantageously find its application in standby, emergency and/or electricity-producing generator sets, as well as in many domestic cogeneration applications producing electricity, heating and air conditioning.

According to other features of the engines according to the invention:

- an accelerator butterfly valve is positioned on the inlet duct of the volumetric relief device with work in order to make it possible to control the engine by letting more or less work gas into the active chamber and/or into its cylinder.
- an accelerator butterfly valve is positioned at the entrance of the very low temperature compressor and preferably controlled by an electronic device in order to make it possible to adjust the inlet, the rate of the compressor while keeping the desired pressure in the constant pressure expansion tank that tends to fall depending on the quantity of gas taken by the volumetric relief device.

BRIEF DESCRIPTION OF THE DRAWINGS

Other objects, advantages and features of the invention will appear on reading the non-limiting description of several embodiments, made with respect to the appended drawings in which.

DETAILED DESCRIPTION OF THE INVENTION

Figure 1:
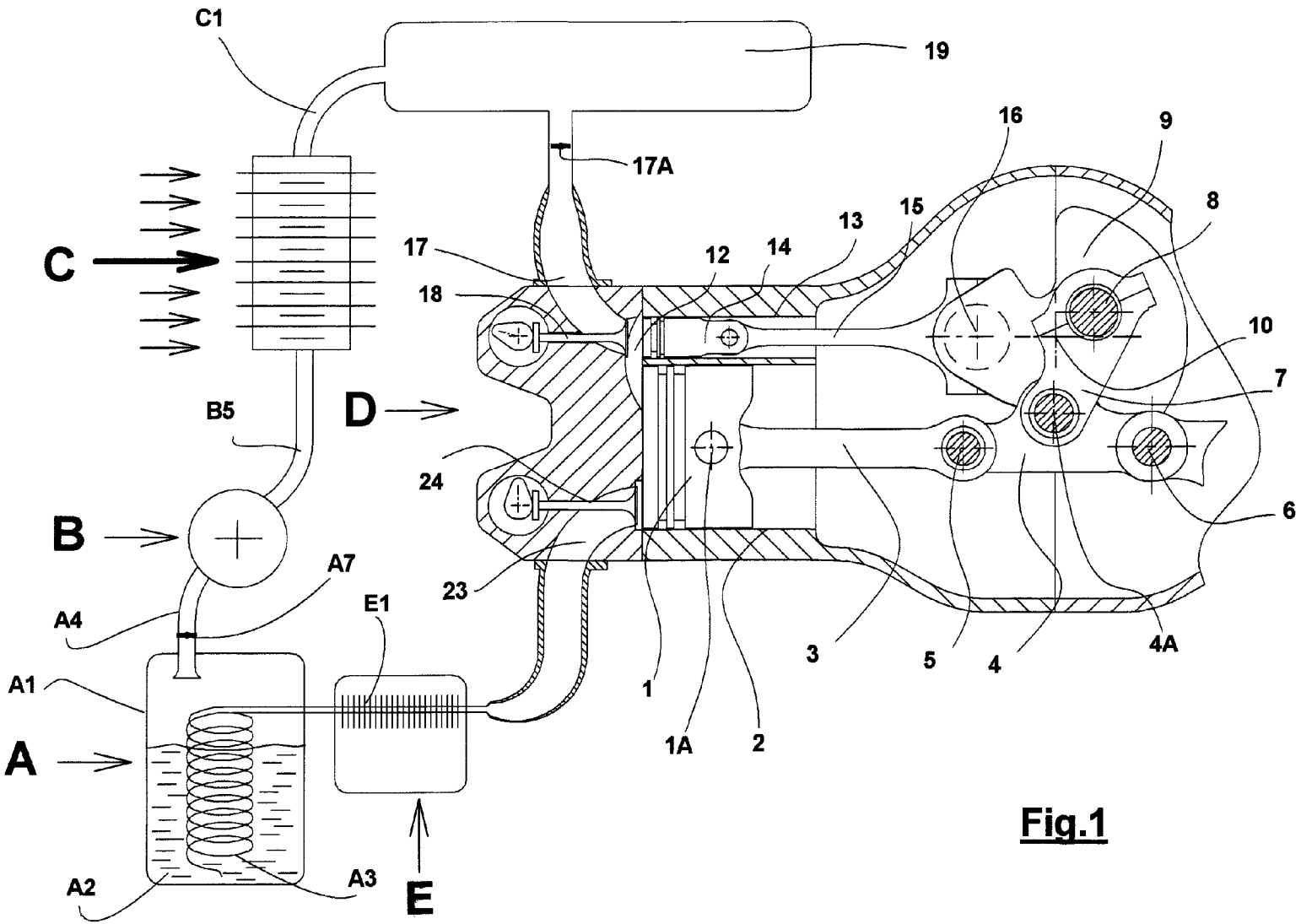
FIG. 1 represents, in block diagram form and schematically seen in cross section, an active chamber cryogenic engine according to the invention.

FIG. 1 represents, in block diagram form and schematically seen in cross section, an ambient temperature thermal energy cryogenic engine according to the invention comprising its five main elements: the cryogenic fluid reservoir in liquid phase A, the very low temperature compressor B, the gas/ambient air exchanger C, the volumetric relief device with work, with active chamber D, and the cryogenic machine for cooling before liquefaction E, where it is possible to see the reservoir A1 in which the cryogenic fluid in liquid phase A2 is stored, and that includes a heat exchanger for liquefaction and vaporization A3. This reservoir is connected via a duct A4 to the inlet of a very low temperature compressor B whose exhaust is connected via a duct B5 to a cryogenic fluid/ambient air exchanger C itself connected via a duct C1 to a constant pressure expansion tank 19 itself connected to the inlet 17 of the active chamber volumetric relief device comprising a drive piston 1 (shown at its top dead centre), sliding in a cylinder 2 and controlled by a pressure lever. The drive piston 1 is connected via its shaft to the free end 1A of a pressure lever consisting of an arm 3 articulated on a common shaft 5 to another arm 4 fixed oscillatingly on an immobile shaft 6, and on which is arranged, substantially in its middle, a shaft 4A to which is attached a control connecting rod 7 connected to the crank pin 8 of a crankshaft 9 rotating on its axis 10. During the rotation of the crankshaft, the control connecting rod 7 through the lower arm 4 and its shaft 4A exerts a force on the common shaft 5 of the two arms 3 and 4 of the pressure lever, thereby allowing the piston 1 to move along the axis of the cylinder 2, and in return transmits to the crankshaft 9 the forces exerted on the piston 1 during the drive stroke thereby causing it to rotate. The engine cylinder 2 is in communication via a passage 12 made in its top portion, with the active chamber cylinder 13 in which a piston 14 slides, called the pressure piston connected via a connecting rod 15 to a crank pin 16 (in dotted line) of the crankshaft 9. An inlet duct 17, controlled by a valve 18 opens into the passage 12 that connects the engine cylinder 2 and the active chamber cylinder 13 makes it possible to supply the engine with compressed gas (cryogenic fluid in the gaseous phase) originating from the expansion tank 19 kept at a quasi-constant pressure. In the upper portion of the engine cylinder 2, an exhaust duct 23 is made, controlled by an exhaust valve 24, connected to the liquefaction and vaporization heat exchanger A3 after having passed through a cold chamber E that makes it possible to cool the cryogenic fluid of the exhaust and prepare it for its liquefaction in the heat exchanger A3.

An accelerator butterfly valve 17A is positioned on the inlet duct of the volumetric relief device with work D and makes it possible to control the engine by letting more or less work gas into the active chamber 12, 13.

An accelerator butterfly valve A7 is positioned on the inlet duct A4 of the very low temperature compressor; it is preferably controlled by an electronic device to make it possible to regulate at the inlet, the output of the compressor while keeping the desired pressure in the constant pressure expansion tank 19, which falls depending on the quantity of gas taken by the engine.

Figure 2:
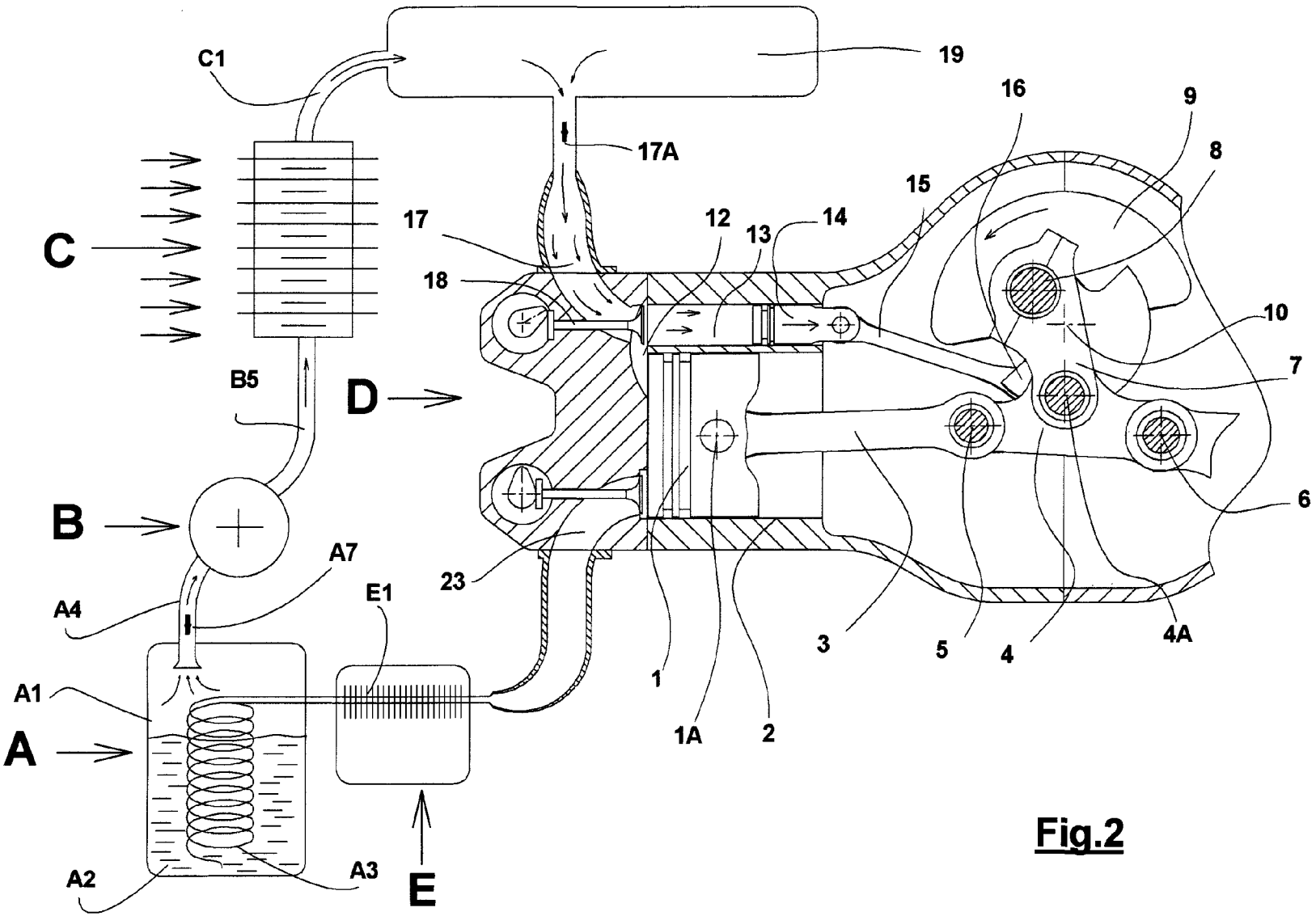
FIGS. 2 to 4 represent, in block diagram form and schematic views in cross section, the various operating phases of the engine according to the invention.

The cryogenic fluid in liquid phase A2 is vaporized in the gaseous phase with the aid of the heat exchanger A3 and aspirated through the inlet duct A4 by the cryogenic fluid compressor B; the cryogenic work fluid in gaseous form but still at very low temperature is then compressed for example to 30 bar and discharged through the duct B6 to the ambient air/cryogenic fluid exchanger C where its temperature will rise virtually to the ambient temperature causing the increase of its volume in order subsequently to be directed via the duct C1 to the constant pressure expansion tank 19 connected via an inlet duct 17 to the volumetric relief device with work with active chamber D where, FIG. 2, the drive piston 1 is stopped in its top dead centre position and the inlet valve 18 has just been opened; the pressure of the gas contained in the constant pressure expansion tank 19 pushes the pressure piston 14 while filling the cylinder of the active chamber 13 and producing work by causing via its connecting rod 15 the rotation of the crankshaft 9, the work being considerable because it is carried out at quasi-constant pressure over the whole stroke of the pressure piston 14.

Figure 3:
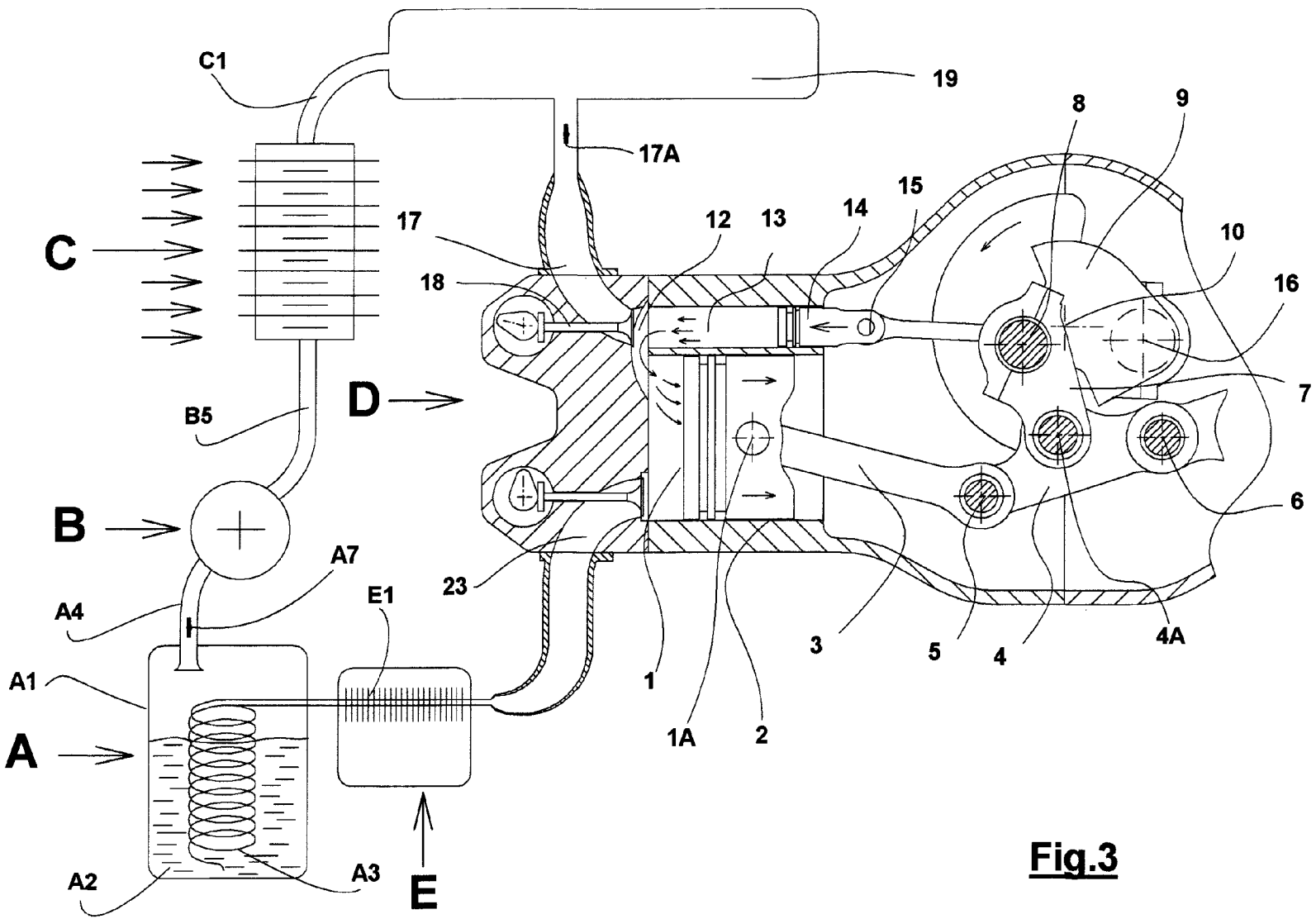

By continuing its rotation, the crankshaft allows—FIG. 3—the drive piston 1 to move to its bottom dead centre and substantially simultaneously the inlet valve 18 is then closed again; the load contained in the active chamber then expands while pushing the drive piston 1 which in its turn produces work by rotating the crankshaft 9 through its mobile equipment consisting of the arms 3 and 4 and the control connecting rod 7.

Figure 4:
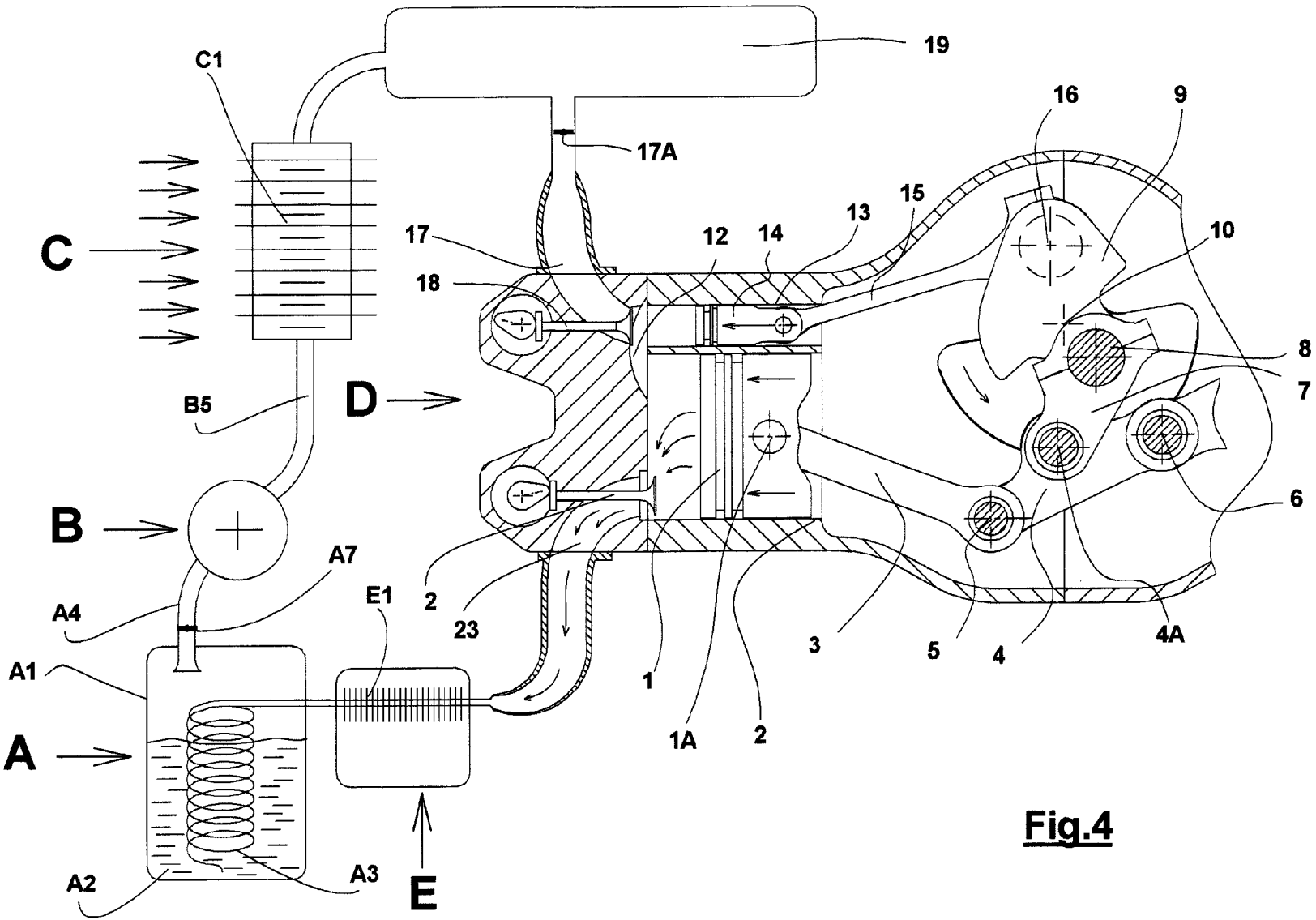

During this cycle of the drive piston 1, the pressure piston 14 continues its stroke to bottom dead centre and commences its upstroke to its top dead centre, all the elements being set up so that, during the upstroke of the pistons—see FIG. 4—the pressure piston 14 and the drive piston 1 arrive substantially together at their top dead centre where the drive piston 1 will stop and the pressure piston 14 will begin a new downstroke in order to recommence a new work cycle. During the upstroke of the two pistons 1 and 14, the exhaust valve 24 is opened in order to return the cryogenic fluid, intensely cooled during its expansion through the exhaust duct 23 and the cryogenic machine E and its heat exchanger E1, to the reservoir A where it will be liquefied during its passage into the heat exchanger A3 and returned to the tank in order to recommence a new cycle.

Figure 5:
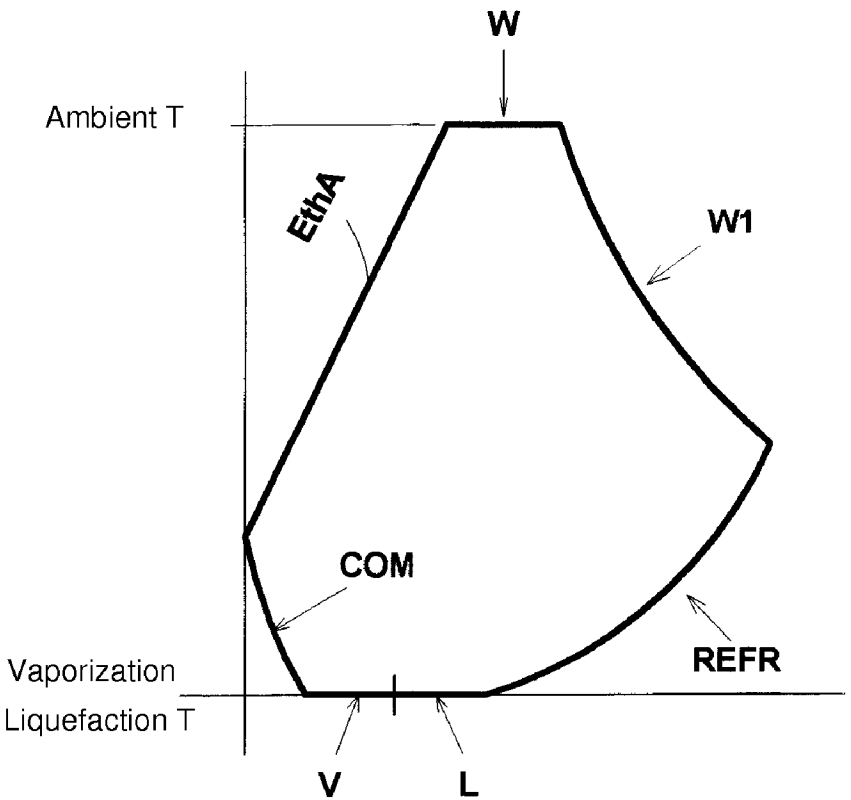
FIG. 5 represents schematically a temperature/volume diagram of the thermodynamic cycle of the cryogenic engine.

FIG. 5 represents a temperature/volume diagram of the thermodynamic cycle according to the invention in which, on the horizontal axis, can be seen the temperatures and on the vertical axis the gas volumes employed and the various segments relating to the cycle, vaporization (segment V) then compression to the work pressure (segment Com). The gas is then taken to the (quasi) ambient temperature at constant pressure (segment EthA), in order subsequently to be transferred on a quasi-isotherm and at constant pressure while producing work (segment W) into the active chamber of the engine and expand (segment W1) according to a polytropic, producing work, cooling and moving closer to the atmospheric pressure, in order subsequently to be inserted into a cryogenic machine (segment REFR) in order to be intensely cooled then liquefied L and to make it possible to recommence the thermodynamic cycle.

The invention is not limited to the exemplary embodiments described and represented; the materials, the control means, the devices described may vary within the limit of the equivalents to produce the same results, without, for all that, changing the invention that has just been described.

The invention claimed is:

1. An ambient temperature thermal energy and constant pressure cryogenic engine, comprising:

a cryogenic fluid reservoir (A) configured to hold a cryogenic work fluid in a liquid phase (A2), the cryogenic fluid reservoir (A) comprising a fluid heat exchanger (A3) for liquefaction of the fluid into the liquid phase, the cryogenic fluid is a gaseous state being a work gas;

a gas compressor (B) to compress a vaporized phase of the fluid into the liquid phase of the fluid;

a first duct (A4) connecting the cryogenic fluid reservoir (A) to an inlet of the gas compressor (B);

a constant pressure expansion tank (19), an exhaust of the compressor (B) being fed to the constant pressure expansion tank (19);

an volumetric relief device (D) with an active chamber, the constant pressure expansion tank (19) connected to an inlet of the volumetric relief device (D), the active chamber (D) comprised of a drive piston (1), the drive piston sliding in a cylinder (2) and controlled by a pressure lever, the cylinder having an exhaust duct (23), the active chamber (D) defining a variable volume producing work, the variable volume coupled, and in permanent contact via a passage, with a space lying above the drive piston so that i) with the space lying above the drive piston at a smallest volume and under thrust of the work gas, the space will increase in volume while producing work, and ii) when the space is at a largest volume, the work gas expands in the engine cylinder thereby pushing back the drive piston in a downstroke while producing work in turn and thereby undergoing a reduction of temperature; and a cryogenic machine (E) for cooling the fluid before the liquefaction of the fluid by the heat exchanger (A3) in the fluid reservoir (A), the exhaust duct (23) connecting the cylinder (2) to the cryogenic machine (E), wherein, in a thermodynamic cycle in the fluid storage reservoir (A) the liquid phase of the fluid is vaporized, substantially at a vaporization temperature of the fluid, and the vaporized fluid is supplied to the inlet (A4) of the gas compression volumetric device (B), the gas compressor compressing the vaporized gas to a work pressure to form a compressed work gas at an outlet of the gas compress (B), the compressed work gas is discharged into the expansion tank (19) at the work pressure and taken, by heat exchange with atmosphere, substantially to ambient temperature, such that, under effect of transfer of thermal energy from the ambient temperature, the temperature of the compressed gas increases and the compressed gas volume increases in same proportions according to a constant pressure relation: V1/V2=T1/T2 so that with said gas still compressed at the work pressure and still substantially at the ambient temperature is let into the volumetric relief device, the work gas, on being exhausted from the exhaust duct (23) of the said volumetric relief device, is discharged towards the storage reservoir (A) to be liquefied in order to recommence a new thermodynamic cycle.

2. An ambient temperature thermal energy and constant pressure cryogenic engine according to claim 1, the thermodynamic cycle comprises seven phases:

a vaporization of a cryogenic fluid, a compression of the vaporized cryogenic fluid, reheating at constant pressure by the ambient temperature, a quasi-isothermal transfer producing work, a polytropic relief providing work with temperature reduction, a closed cycle exhaust into the storage reservoir, and a liquefaction of the gas returned to the storage reservoir.

3. An ambient temperature thermal energy and constant pressure cryogenic engine according to claim 2, wherein, the vaporization of the fluid in the liquid phase in the storage reservoir (A) is obtained by heating by using the fluid heat exchanger (A3) in which the cryogenic fluid then in a semi-gaseous phase and returned from the exhaust (23) of the volumetric relief device (D), heats and vaporizes a portion of the cryogenic fluid in the liquid phase (A2) that is in the storage reservoir (A) while cooling and liquefying.

4. An ambient temperature thermal energy and constant pressure cryogenic engine according to claim 3, wherein, the cryogenic fluid reservoir (A) comprises a tank, the cryogenic fluid liquefaction vaporization heat exchanger (A3) comprises a coil immersed in the tank, the fluid originating from the exhaust of the engine terminates cooling and liquefaction while giving off the heat to vaporize the fluid in the liquid state in the storage reservoir.

5. An ambient temperature thermal energy and constant pressure cryogenic engine according to claim 3, wherein, the cryogenic machine (E) comprises a heat exchanger (E1) positioned in a cold chamber of the cryogenic machine (E) between the exhaust duct (23) and the fluid storage reservoir (A, A1) arranged to adjust the temperature of the work gas relieved at the outlet of the exhaust duct (23) before the work gas is inserted into the heat exchanger (A3) of the storage reservoir (A1), and the fluid, in the gaseous or semi-gaseous state at the outlet of the exhaust duct (23), is cooled during passage in the heat exchanger (E1).

6. An ambient temperature thermal energy and constant pressure cryogenic engine according to claim 5, wherein, the cryogenic machine (E) operates by using magnetic-calorific effects to heat up under the effect of a magnetic field and to cool down to a temperature lower than an initial temperature after a variation of the magnetic field.

7. An ambient temperature thermal energy and constant pressure cryogenic engine according to claim 6, wherein, the thermodynamic cycle comprises eight phases:

a vaporization of a cryogenic fluid, a compression of the vaporized cryogenic fluid, reheating at constant pressure by the ambient temperature, a quasi-isothermal transfer producing work, a polytropic relief providing work with temperature reduction, a closed cycle exhaust into the storage reservoir, a liquefaction of the gas returned to the storage reservoir, and a cooling in a cryogenic machine.

8. An ambient temperature thermal energy and constant pressure cryogenic engine according to claim 7, further comprising at least one atmospheric air/work gas exchanger (C) installed between the compressor (B) and the constant pressure expansion tank (19);

a second duct (B2) connecting the gas/ambient air exchanger (C) to an exhaust of the compressor (B); and a third duct (C1) connecting the gas/ambient air exchanger (C) to the constant pressure expansion tank (19).

9. An ambient temperature thermal energy and constant pressure cryogenic engine according to claim 1, wherein, the constant pressure expansion tank (19) comprises a volume working pressure storage reservoir in which the work gas contained therein, kept at the ambient temperature, according to a heat exchange surface area of a casing the said pressure storage reservoir with the atmosphere, a volume and a storage time in the said volume working pressure storage reservoir, and the compressed work gas originating from the gas compressor (B) is taken to the ambient temperature by mixing with the work gas at ambient temperature already contained in the said pressure storage reservoir.

10. An ambient temperature thermal energy and constant pressure cryogenic engine according to claim 9, wherein, the casing of the said pressure storage reservoir (19) comprises heat exchange elements for promoting the heat exchange between the atmosphere and the work gas contained therein.

11. An ambient temperature thermal energy and constant pressure cryogenic engine according to claim 9, wherein, the thermodynamic cycle comprises nine phases:

a vaporization of a cryogenic fluid, a compression of the vaporized cryogenic fluid, reheating at constant pressure by the ambient temperature, a quasi-isothermal transfer producing work, a polytropic relief providing work with temperature reduction, a closed cycle exhaust into the storage reservoir, a liquefaction of the gas returned to the storage reservoir, a cooling in a cryogenic machine, and a liquefaction of the gas returned to the tank.

12. An ambient temperature thermal energy and constant pressure cryogenic engine according to claim 1, further comprising:

a work gas heating device, positioned before insertion of the work gas into the engine to obtain temperatures higher than the ambient temperature.

13. An ambient temperature thermal energy and constant pressure cryogenic engine according to claim 1, further comprising:

a device for controlling the stroke of the drive piston (1) causing the piston to stop at a top dead center for a period of time, wherein, during the stopping of the drive piston (1) at the top dead center, the pressurized gas is let into the active chamber (D) defined by an active expansion and relief chamber (12, 13), when the active expansion and relief chamber (12, 13) is substantially at a largest volume, a inlet duct (17) thereof is then closed and the work gas, still compressed under pressure, contained in the said active expansion and relief chamber (12, 13), expands in the engine cylinder (2) thereby pushing back the drive piston (1) in the downstroke while producing work in the turn and thereby undergoing a reduction of temperature, and during the upstroke of the drive piston (1) during the exhaust stroke, the variable volume of the active expansion and relief chamber (12, 13) is returned to the smallest volume in order to recommence a complete work cycle.

14. An ambient temperature thermal energy and constant pressure cryogenic engine according to claim 1, further comprising:

an accelerator butterfly valve (17A) positioned on a inlet duct (17) of the volumetric relief device (D), the accelerator butterfly valve (17A) arranged to control the engine by letting more and less work gas into one of i) the active chamber and ii) the cylinder (2).

15. An ambient temperature thermal energy and constant pressure cryogenic engine according to claim 1, wherein, an accelerator butterfly valve (A7) is positioned at the inlet of the gas compressor (B) and controlled to adjust the inlet of the gas compressor (B), and the accelerator butterfly valve (A7) controlling a rate of the gas compressor (B) while keeping a desired pressure in the constant pressure expansion tank (19).

* * * * *